US006644770B1

(12) United States Patent
Niimura et al.

(10) Patent No.: US 6,644,770 B1
(45) Date of Patent: Nov. 11, 2003

(54) PRINTING APPARATUS, CONTROL METHOD OF THE APPARATUS, AND COMPUTER-READABLE MEMORY

(75) Inventors: Hiroyuki Niimura, Kawasaki (JP); Hiroshi Tajika, Yokohama (JP); Norihiro Kawatoko, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,474

(22) Filed: Sep. 6, 2000

(30) Foreign Application Priority Data

Sep. 7, 1999 (JP) ..... 11-253491

(51) Int. Cl.[7] ..... B41J 29/38; B41J 29/393

(52) U.S. Cl. ..... 347/14; 347/19

(58) Field of Search ..... 347/19, 14, 17

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,745,130 A | * | 4/1998 | Becerra et al. | 347/14 |
| 5,880,751 A | | 3/1999 | Nishikori et al. | 347/14 |
| 5,894,314 A | | 4/1999 | Tajika et al. | 347/14 |

FOREIGN PATENT DOCUMENTS

| | | |
|---|---|---|
| EP | 0 980 758 | 2/2000 |
| JP | 59-123670 | 7/1984 |
| JP | 59-138461 | 8/1984 |

* cited by examiner

*Primary Examiner*—Thinh Nguyen
(74) *Attorney, Agent, or Firm*—Fitzpatrick, Cella, Harper & Scinto

(57) ABSTRACT

A head unit detects the temperature of its internal printhead a plurality of number of times, and generates a plurality of digital signals corresponding to respective temperatures. The head unit determines a digital signal used as the temperature of the printhead on the basis of the generated digital signals. The head unit transmits the determined digital signal to a main unit having a main PCB. The main unit receives the digital signal transmitted from the head unit. The main unit executes printing control of the printhead based on the received digital signal.

34 Claims, 17 Drawing Sheets

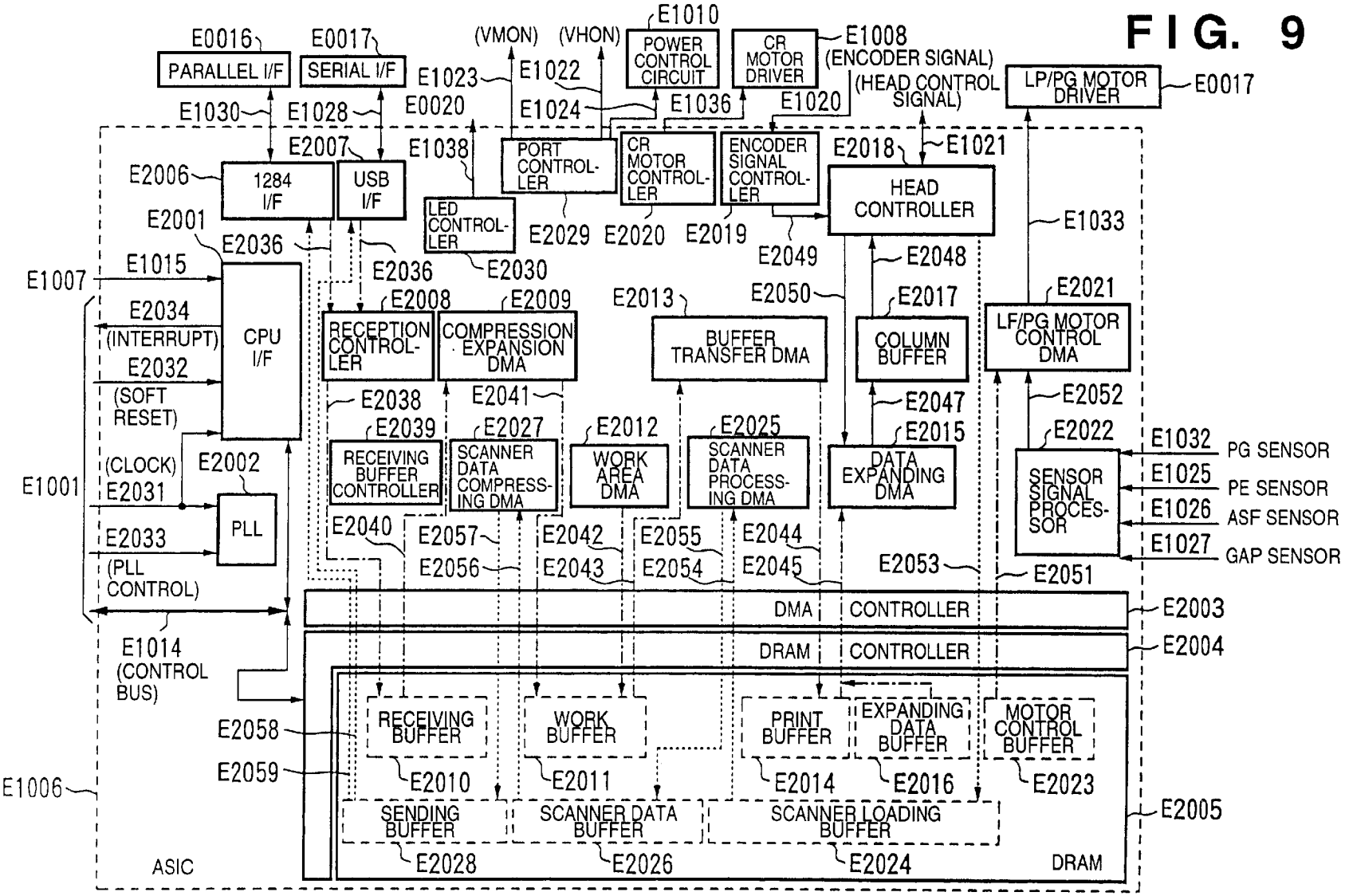
FIG. 9
LP/PG MOTOR DRIVER
E0017
E1033
E2021
LF/PG MOTOR CONTROL DMA
E2052
E2022
SENSOR SIGNAL PROCES-SOR
E1032
E1025
E1026
E1027
PG SENSOR
PE SENSOR
ASF SENSOR
GAP SENSOR
E2003
E2004
E2005
E2051
CONTROLLER
CONTROLLER
DRAM
MOTOR CONTROL BUFFER
E2023
DRAM
E1021
HEAD CONTROLLER
E2018
E2048
E2017
COLUMN BUFFER
E2047
E2015
DATA EXPANDING DMA
E2053
E1008
(ENCODER SIGNAL)
(HEAD CONTROL SIGNAL)
CR MOTOR DRIVER
E1020
ENCODER SIGNAL CONTROL-LER
E2019
E2049
E2050
BUFFER TRANSFER DMA
E2025
SCANNER DATA PROCESS-ING DMA
E2044
E2045
DMA
DRAM
EXPANDING DATA BUFFER
E2016
PRINT BUFFER
E2014
SCANNER LOADING BUFFER
E2024
E1010
POWER CONTROL-CIRCUIT
E1036
CR MOTOR CONTROL-LER
E2020
E2013
E2012
WORK AREA DMA
E2055
E2054
E2043
E2042
WORK BUFFER
E2011
SCANNER DATA BUFFER
E2026
(VHON)
(VMON)
E1022
E1024
PORT CONTROL-LER
E2029
E2009
COMPRESSION EXPANSION DMA
E2041
E2027
SCANNER DATA COMPRESS-ING DMA
E2030
E1023
E0020
E1038
LED CONTROL-LER
E2008
RECEPTION CONTROL-LER
E2038
E2039
RECEIVING BUFFER CONTROLLER
E2040
E2057
E2056
RECEIVING BUFFER
E2010
SENDING BUFFER
E2028
E0017
SERIAL I/F
E1028
E2007
USB I/F
E2036
E0016
PARALLEL I/F
E1030
E2006
1284 I/F
E2001
E2036
CPU I/F
E2002
PLL
E2058
E2059
E1015
E2034
(INTERRUPT)
E2032
(SOFT RESET)
(CLOCK)
E2031
E2033
(PLL CONTROL)
E1014
(CONTROL BUS)
ASIC
E1007
E1001
E1006

CONNECT APPARATUS TO POWER SUPPLY
FIRST INITIALIZATION
S1
1
S2
NO
POWER KEY ON INPUT CHECK?
YES
SECOND INITIALIZATION
S3
2
S4
WAIT FOR EVENT?
PRINT COMMAND RECEPTION
POWER KEY OFF INPUT
ANOTHER EVENT INPUT
S10
S11
S5
COMMAND ANALYSIS
PRINTER TERMINATION PROCESS
EVENT PROCESSING
S6
PAPER FEED
1
2
S7
PRINT
S8
PAPER DELIVERY
S9
NO
ARE ALL PAGES COMPLETELY PRINTED?
YES
2

FIG. 12

| HEAD TEMPERATURE (℃) | ~ 5 | 5 ~ 20 | 20 ~ 25 | 25 ~ 30 | 30 ~ 35 | 35 ~ 40 | 40 ~ 45 | 45 ~ 50 | 50 ~ 55 | 55 ~ 60 | 60 ~ 90 | 90~ |
|---|---|---|---|---|---|---|---|---|---|---|---|---|
| DIGITAL TEMPERATURE INFORMATION | 1 | 2 | 3 | 4 | 5 | 6 | 7 | 8 | 9 | 10 | 11 | 12 |
| DISCHARGE PARAMETER A | a1 | a2 | a3 | a4 | a5 | a6 | a7 | a8 | a9 | a10 | a11 | a12 |
| DISCHARGE PARAMETER B | b1 | b2 | b3 | b4 | b5 | b6 | b7 | b8 | b9 | b10 | b11 | b12 |
| DISCHARGE PARAMETER C | c1 | c2 | c3 | c4 | c5 | c6 | c7 | c8 | c9 | c10 | c11 | c12 |

PRINTING APPARATUS, CONTROL METHOD OF THE APPARATUS, AND COMPUTER-READABLE MEMORY

FIELD OF THE INVENTION

The present invention relates to a printing apparatus having a head unit with a printhead and a main unit with a control circuit for executing printing control of the printhead, a control method of the apparatus, and a computer-readable memory.

Note that the present invention is applicable not only to a general printing apparatus but also to a copying machine, a facsimile apparatus having a communication system, a word processor having a printing unit, and an industrial printing apparatus combined with various processors.

BACKGROUND OF THE INVENTION

In a conventional inkjet printer for performing printing by discharging ink by heat generated by a heater, the discharge state changes depending on the heated state of a printhead including the heater. To perform accurate discharge control, an accurate printhead temperature must be acquired. To more accurately acquire the printhead temperature and use it for each control, an analog output concerning temperature information from the printhead is converted into a digital output, which is used for each control.

The conventional inkjet printer informs a main unit for controlling printing of temperature information of the printhead using an analog signal from a head unit which mounts the printhead. In this case, the main unit must A/D-convert the received analog signal. When this A/C conversion processing contends with another A/D conversion processing, for example, the main unit executes another A/D conversion processing, no accurate value can be attained. In addition, software processes contend with each other owing to an AID conversion processing end interrupt or the like, and may cause deadlock in the worst case. To prevent this, exclusive control must be done. If the temperature is to be determined on the main unit side in consideration of this exclusive control, it takes a long time to determine the temperature. A system using a real-time as may suffer in performing a task during which the system cannot perform processing by exclusive control and must wait.

According to another method, the temperature is detected with higher precision by acquiring, a plurality of number of times, digital signal values obtained by converting analog signals received from the head unit on the main unit side, and determining the average of all the acquired digital signal values as the printhead temperature. Even in this case, however, the distance of a signal line from the head unit to the main unit is long in terms of the printer structure. Noise may be generated in an analog signal received by the main unit, and an analog signal having an excessively large or small value may be mixed to localize the average value of digital values obtained based on the analog signal. Solving this problem requires a check routine for checking whether the value of a digital signal is valid.

From this, it is difficult to perform accurate discharge control based on an obtained temperature.

The present applicant has proposed arrangements for solving this problem by converting an analog temperature detection signal into a digital signal in the head unit and transmitting the digital signal to the main unit.

In these arrangements, however, the following problems arise in performing more accurate temperature detection.

1. When an analog temperature value is converted into a digital value in the head unit, the digital value changes depending on fluctuations of the detected temperature and small variations of the analog signal. It is not always easy to output a digital value which reflects an accurate temperature.

2. Even if analog signals are converted into digital signals to output the digital signals a plurality of number of times within a short time in synchronism with clock signals, a plurality of different digital values may be output. It is not easy to determine which value reflects the true temperature.

Noise may be generated in an analog signal, and an excessively large or small value may be mixed to localize the obtained value to one side.

3. When an analog signal is converted into a digital signal of a plurality of bits, bit inversion (bits "1" and "0" are replaced) may occur around the threshold of the temperature in conversion into a digital value, and an error may occur in conversion into a digital value.

SUMMARY OF THE INVENTION

The present invention has been made to overcome the conventional drawbacks, and has as its object to provide a printing apparatus which is highly resistant to a disturbance such as noise and can execute accurate printing control by more accurately detecting the printhead temperature, a control method of the apparatus, and a computer-readable memory.

A printing apparatus according to the present invention for achieving the above object has the following arrangement. That is, a printing apparatus comprises a head unit with a printhead and a main unit with a control circuit for executing printing control of the printhead, the head unit comprising generation means for detecting a temperature of the printhead a plurality of number of times and generating a plurality of digital signals corresponding to respective temperatures, determination means for determining a digital signal serving as the temperature of the printhead on the basis of the plurality of digital signals generated by the generation means, and transmission means for transmitting the digital signal determined by the determination means to the main unit, and the main unit comprising reception means for receiving the digital signal transmitted from the head unit, and execution means for executing printing control of the printhead on the basis of the digital signal received by the reception means.

This arrangement can prevent deviation of a detected value caused by variations of an analog signal output which readily occurs upon only one temperature detection.

Preferably, the determination means determines the largest number of digital signals having the same value among the plurality of digital signals generated by the generation means as a digital signal serving as the temperature of the printhead.

Preferably, the determination means comprises discrimination means for, when the generation means detects the temperature of the printhead an odd number of times and generates an odd number of digital signals corresponding to respective temperatures, discriminating kinds of digital signals constituting the odd number of digital signals, and the determination means determines a digital signal serving as the temperature of the printhead from the odd number of digital signals on the basis of a discrimination result of the discrimination means.

Preferably, when a kind of digital signal largest in number does not exist among the digital signals constituting the odd number of digital signals, and the number of kinds of digital signals is an even number, digital signals smallest in number and belonging to the same kind are deleted, and the determination means determines digital signals belonging to an intermediate kind among the odd number of kinds of digital signals as digital signals serving as the temperature of the printhead.

Preferably, when a kind of digital signal largest in number does not exist among the digital signals constituting the odd number of digital signals, number of kinds of digital signals is an odd number, the determination means determines digital signals belonging to an intermediate kind among the odd number of kinds of digital signals as digital signals serving as the temperature of the printhead.

According to these aspects, digital signals are output a plurality of number of times, so that a value nearer the true head temperature can be detected even with different output values.

A control method of a printing apparatus according to the present invention for achieving the above object has the following steps. That is, a control method of a printing apparatus having a head unit with a printhead and a main unit with a control circuit for executing printing control of the printhead comprises the generation step of detecting a temperature of the printhead a plurality of number of times and generating a plurality of digital signals corresponding to respective temperatures, the determination step of determining a digital signal serving as the temperature of the printhead on the basis of the plurality of digital signals generated in the generation step, the transmission step of transmitting the digital signal determined in the determination step from the head unit to the main unit, the reception step of receiving the digital signal transmitted from the head unit by the head unit, and the execution step of executing printing control of the printhead on the basis of the digital signal received in the reception step.

A computer-readable memory according to the present invention for achieving the above object has the following program codes. That is, a computer-readable memory storing program codes of control of a printing apparatus having a head unit with a printhead and a main unit with a control circuit for executing printing control of the printhead comprises a program code of the generation step of detecting a temperature of the printhead a plurality of number of times and generating a plurality of digital signals corresponding to respective temperatures, a program code of the determination step of determining a digital signal serving as the temperature of the printhead on the basis of the plurality of digital signals generated in the generation step, a program code of the transmission step of transmitting the digital signal determined in the determination step from the head unit to the main unit, a program code of the reception step of receiving the digital signal transmitted from the head unit by the head unit, and a program code of the execution step of executing printing control of the printhead on the basis of the digital signal received in the reception step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 9 is a block diagram showing the internal arrangement of an ASIC shown in FIG. 8;

FIG. 12 is a table showing the relationship between the printhead temperature, digital temperature information, and discharge parameters in the embodiment;

DETAILED DESCRIPTION OF THE PREFERRED EMBODIMENTS

Embodiments according to a printing apparatus of the present invention will be described below with reference to the accompanying drawings.

In the embodiments to be explained below, a printing apparatus using an inkjet printing system will be described by taking a printer as an example.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Apparatus Main Body

Figure 1:
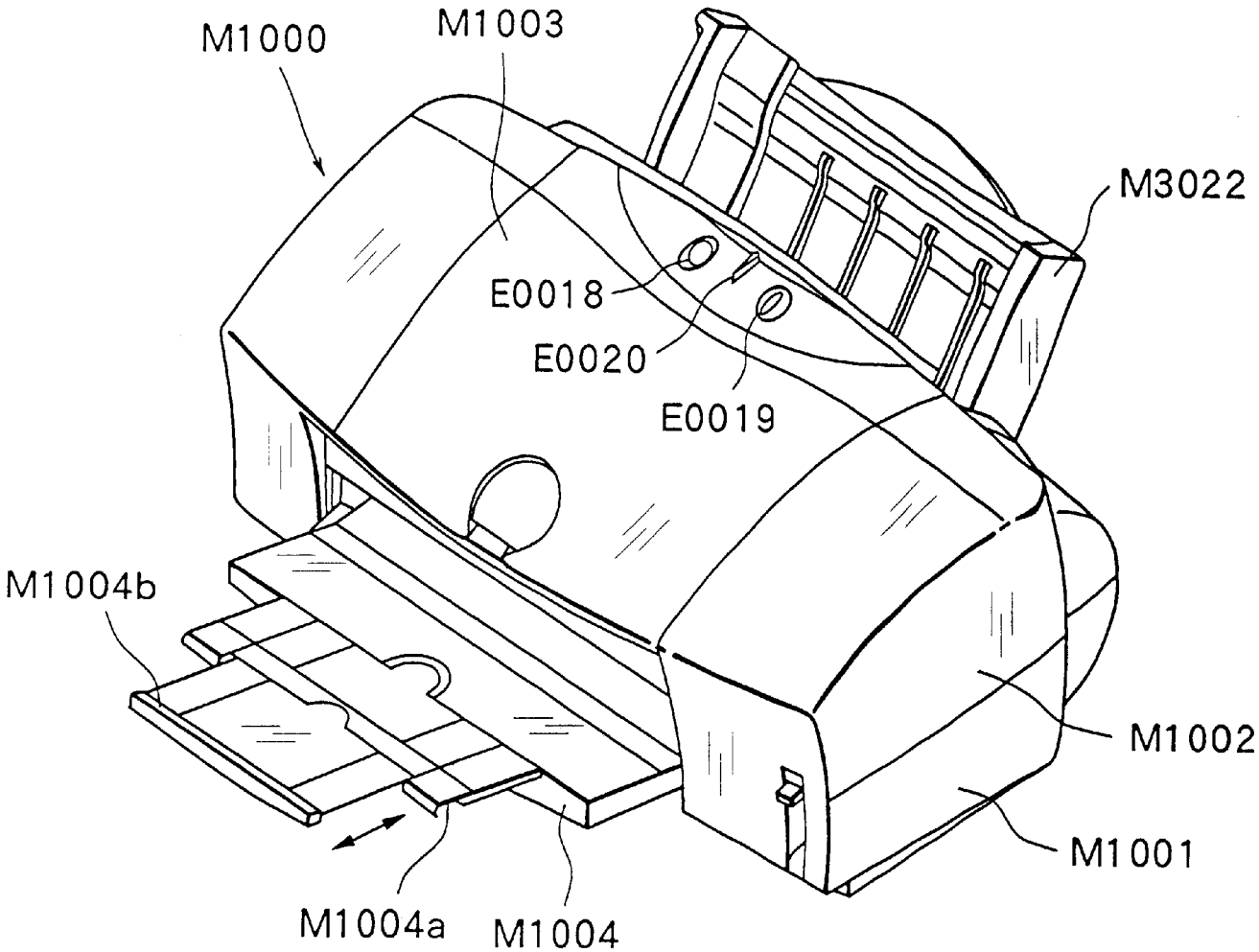
FIG. 1 is a perspective view showing the external appearance of an inkjet printer according to an embodiment of the present invention.
Figure 2:
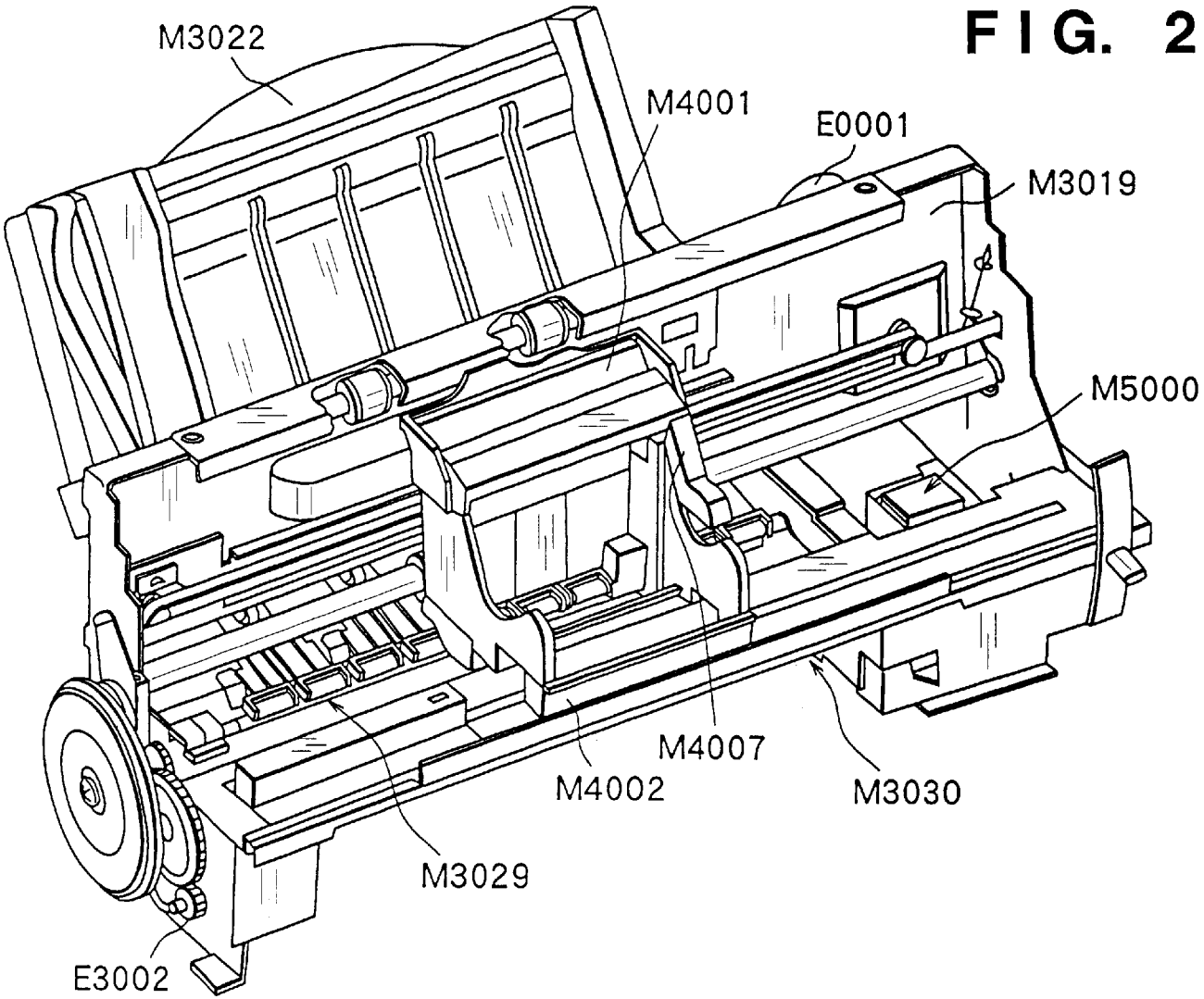
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 forms a substantially lower half of the apparatus main body M1000, and the upper case M1002 forms a substantially upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased and reduced in three steps.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
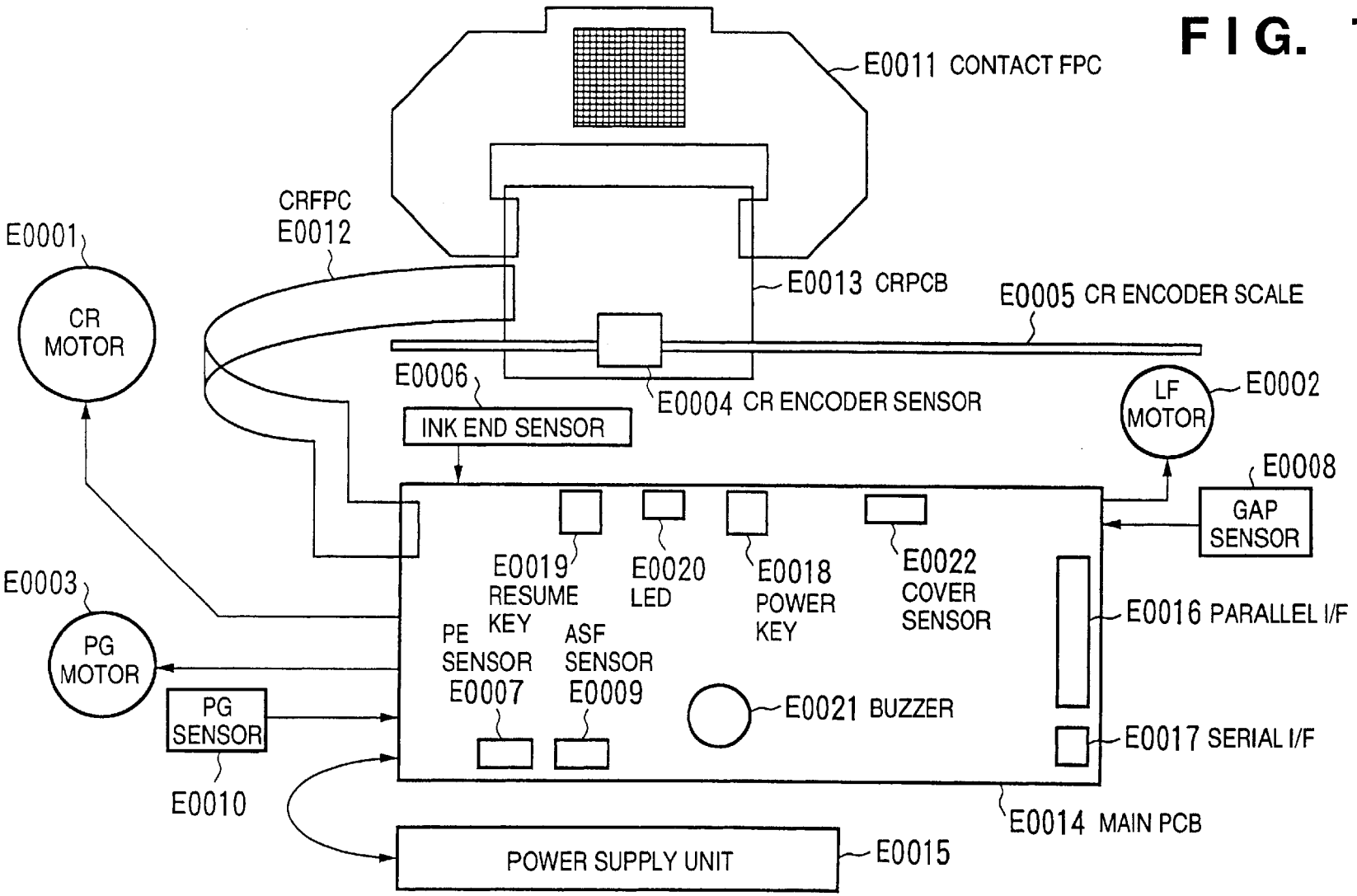
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

Printing Mechanisms

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

(Printing Unit)

The printing unit will be described below.

This printing unit includes a carriage M4001 movably supported by a carriage shaft M4021, and the printhead cartridge H1000 detachably mounted on this carriage M4001.

Printhead Cartridge

First, the printhead cartridge will be described with reference to FIGS. 3 to 5.

Figure 3:
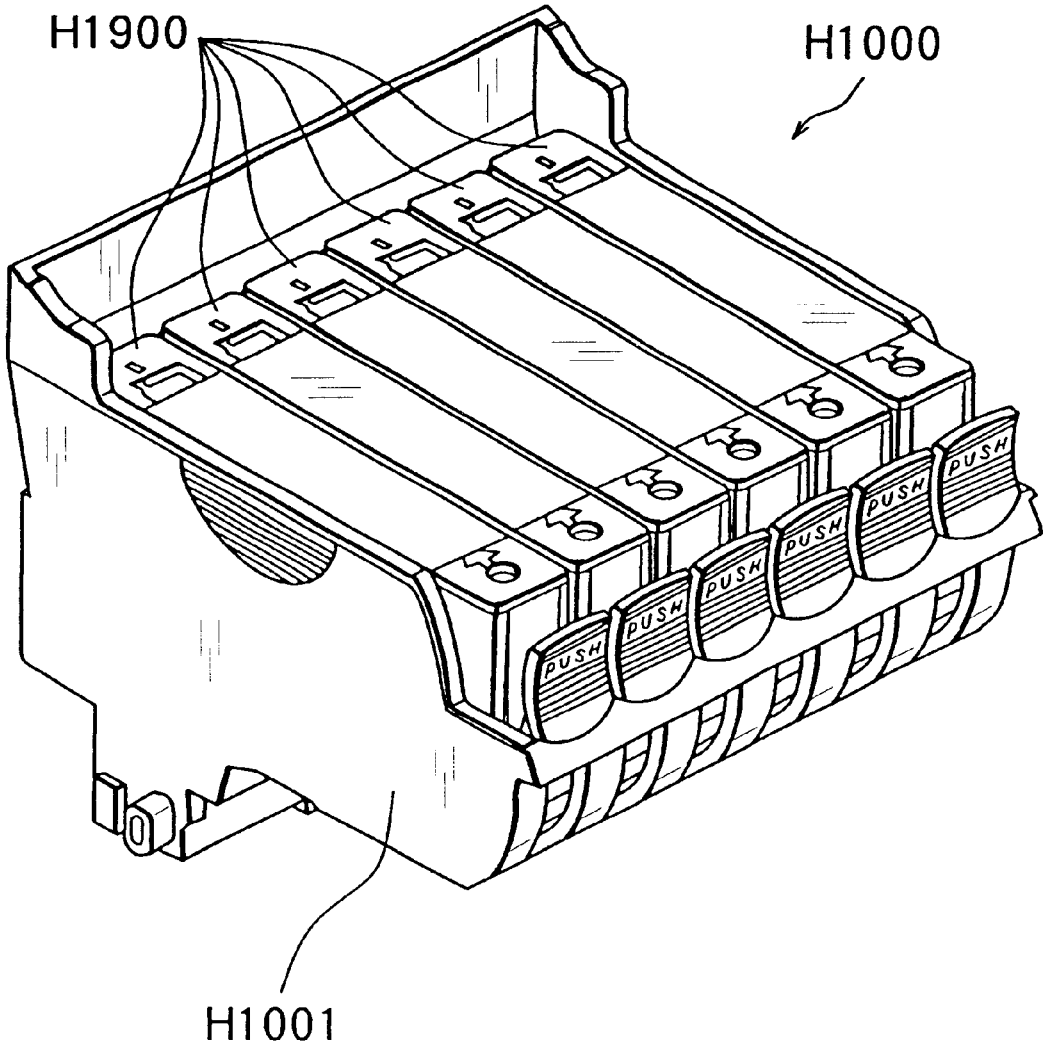
FIG. 3 is a perspective view showing a print head cartridge used in the embodiment of the present invention.
Figure 4:
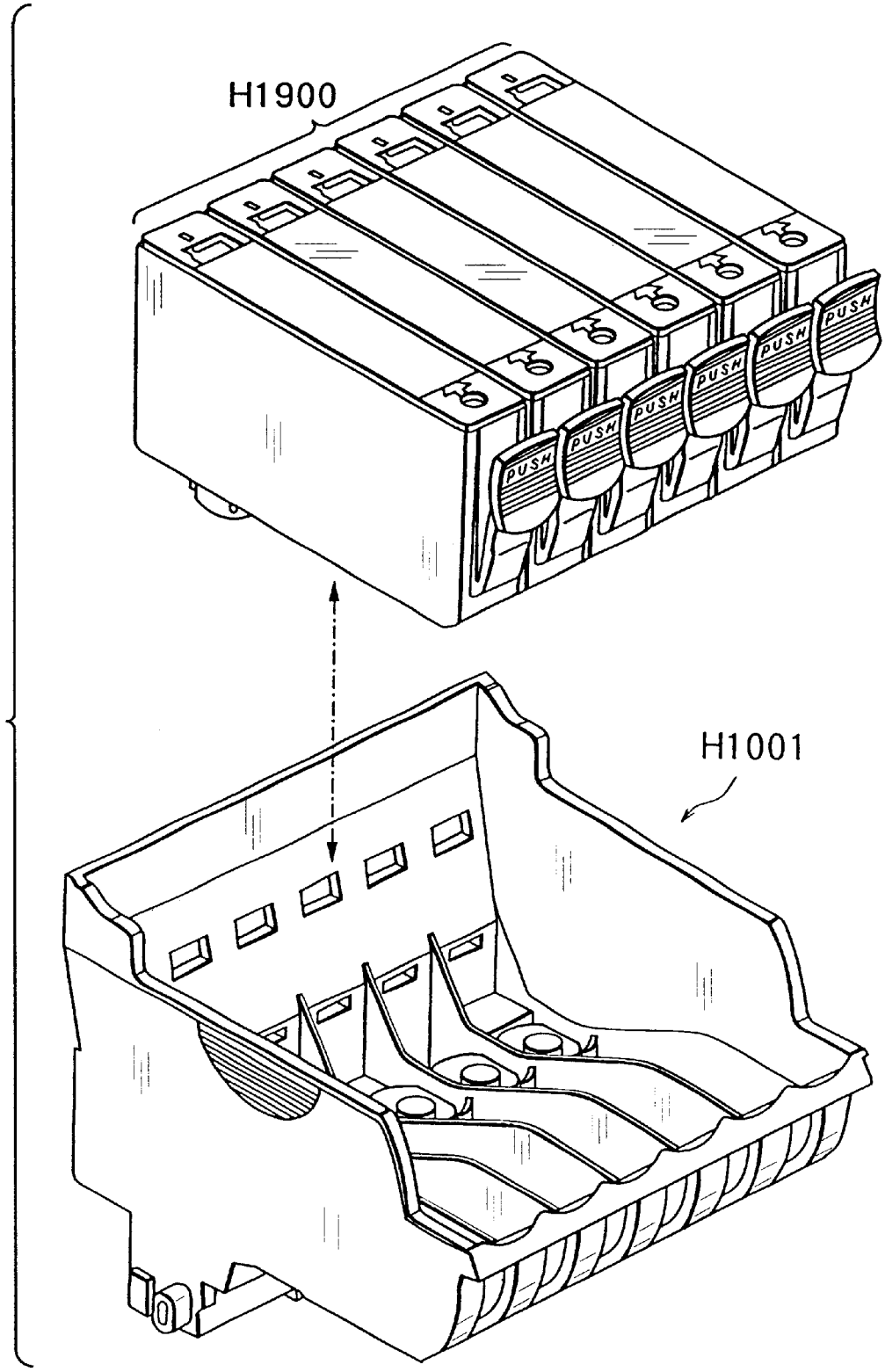
FIG. 4 is a view showing the state in which the printhead cartridge shown in FIG. 3 is assembled.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
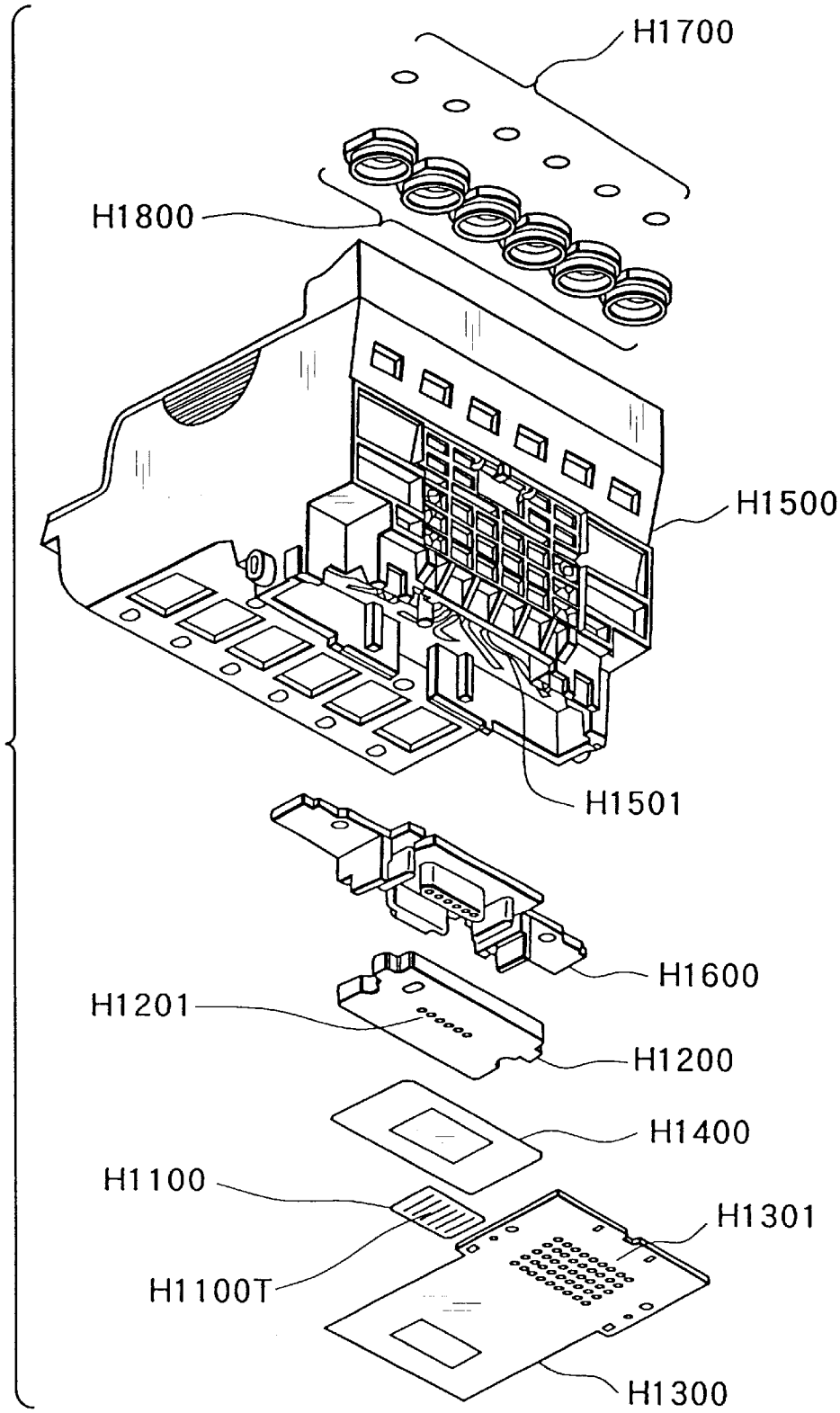
FIG. 5 is an exploded perspective view showing the printhead of FIG. 4 when obliquely viewed from below.

As shown in an exploded perspective view of FIG. 5, the printhead H1001 comprises a printing element board H1100, first plate H1200, electrical printed circuit board H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply ports for supplying ink to these ink channels are formed in the rear surface. This printing element board H1100 is fixed to the first plate H1200 by adhesion. Ink supply ports H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

(Carriage)

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

Scanner

The printer of this embodiment is also usable as a reading apparatus by replacing the printhead with a scanner.

This scanner moves together with the carriage of the printer and reads an original image supplied instead of a printing medium in a sub-scan direction. Information of one original image is read by alternately performing the read operation and the original feed operation.

Figure 6B:
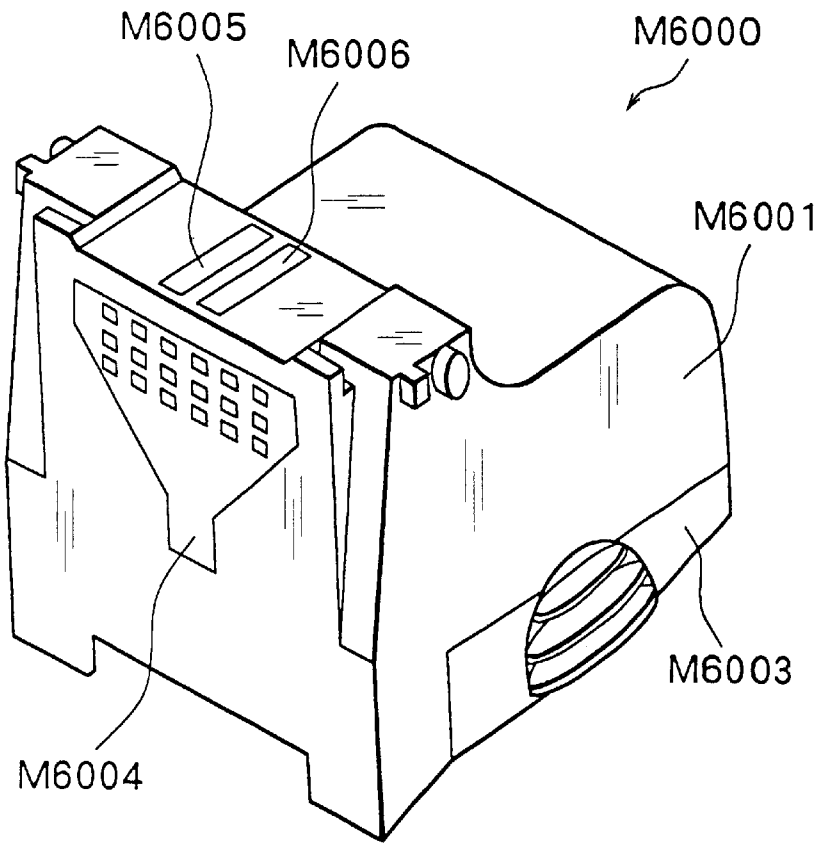
FIGS. 6A and 6B are perspective views showing a scanner cartridge in the embodiment of the present invention.
Figure 6A:
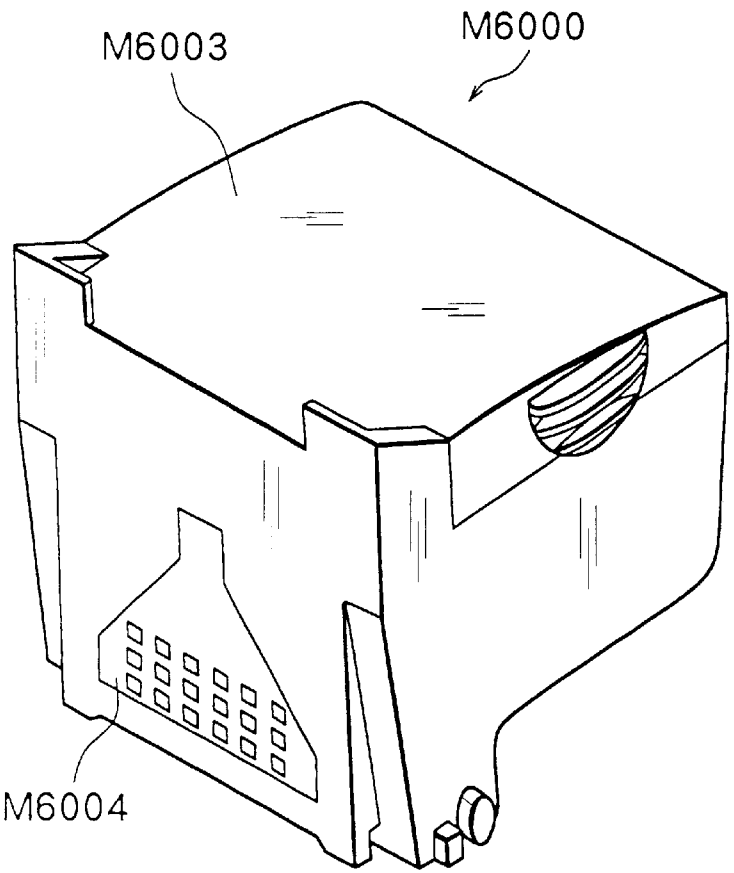

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
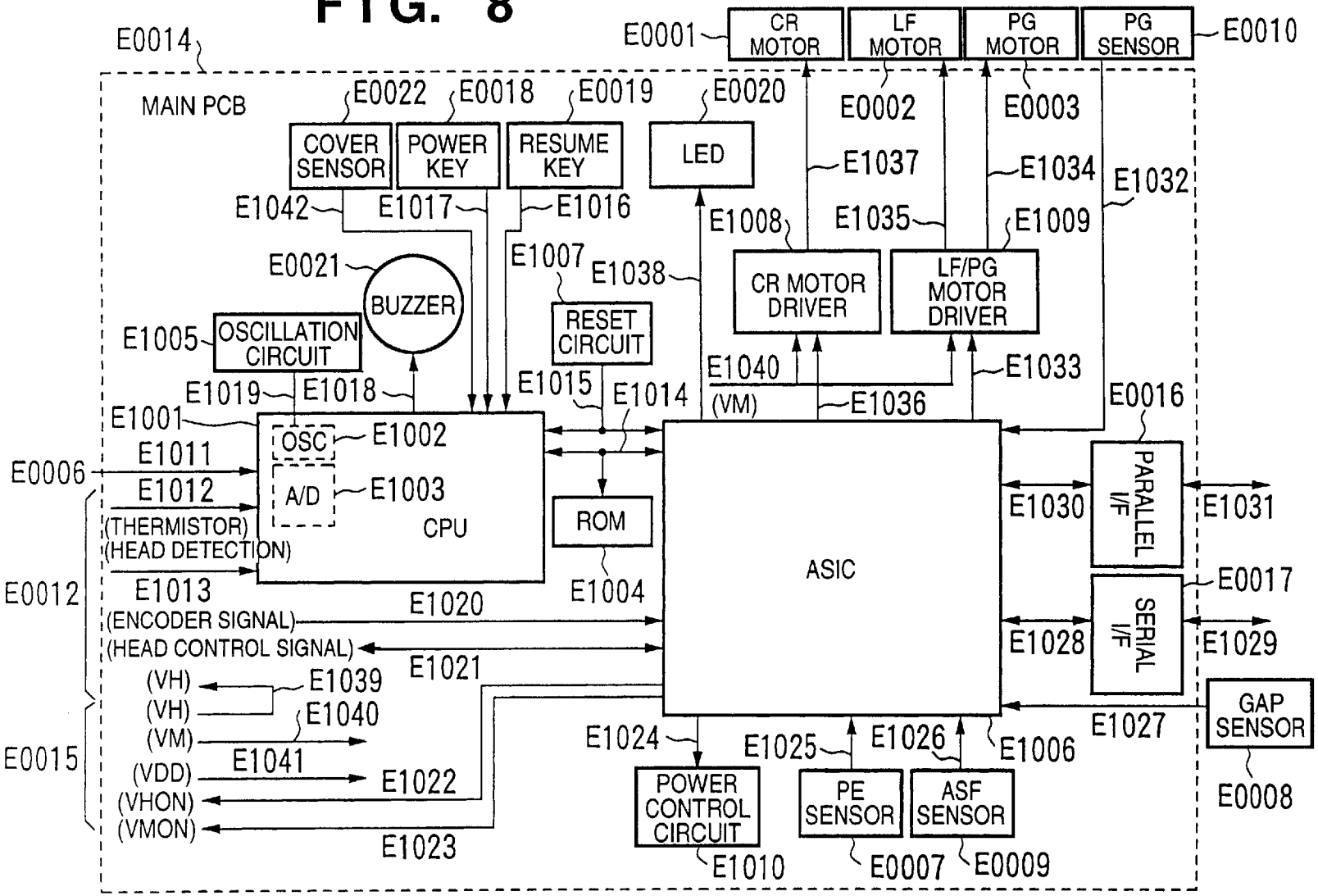
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HSENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, the motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

This ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E10016 and the serial I/F E0017. Also, the ASIC E1006 senses the statuses of a PE sensing signal (PES) E1025 from the PE sensor E0007, an ASF sensing signal (ASFS) E1026 from the ASF sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

FIG. 9 is a block diagram showing the internal arrangement of the ASIC E1006.

Referring to FIG. 9, only flows of data, such as printing data and motor control data, pertaining to control of the head and each mechanical part are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the most part of the ASIC E1006, in accordance with a clock signal (CLK) E2031 and PLL control signal (PLLON) E2033 output from the CPU E1001.

A CPU interface (CPU I/F) E2001 controls read and write to a register in each block (to be described below), supplies clocks to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of generating an interrupt in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between access from the CPU E1001 to the DRAM E2005 using the control bus and access from a DMA controller E2003 (to be described below) to the DRAM E2005, thereby performing read and write to the DRAM E2005.

The DMA controller E2003 accepts a request (not shown) from each block and outputs, to the RAM controller, an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has requested.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by DMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression-expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2016 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the abovementioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
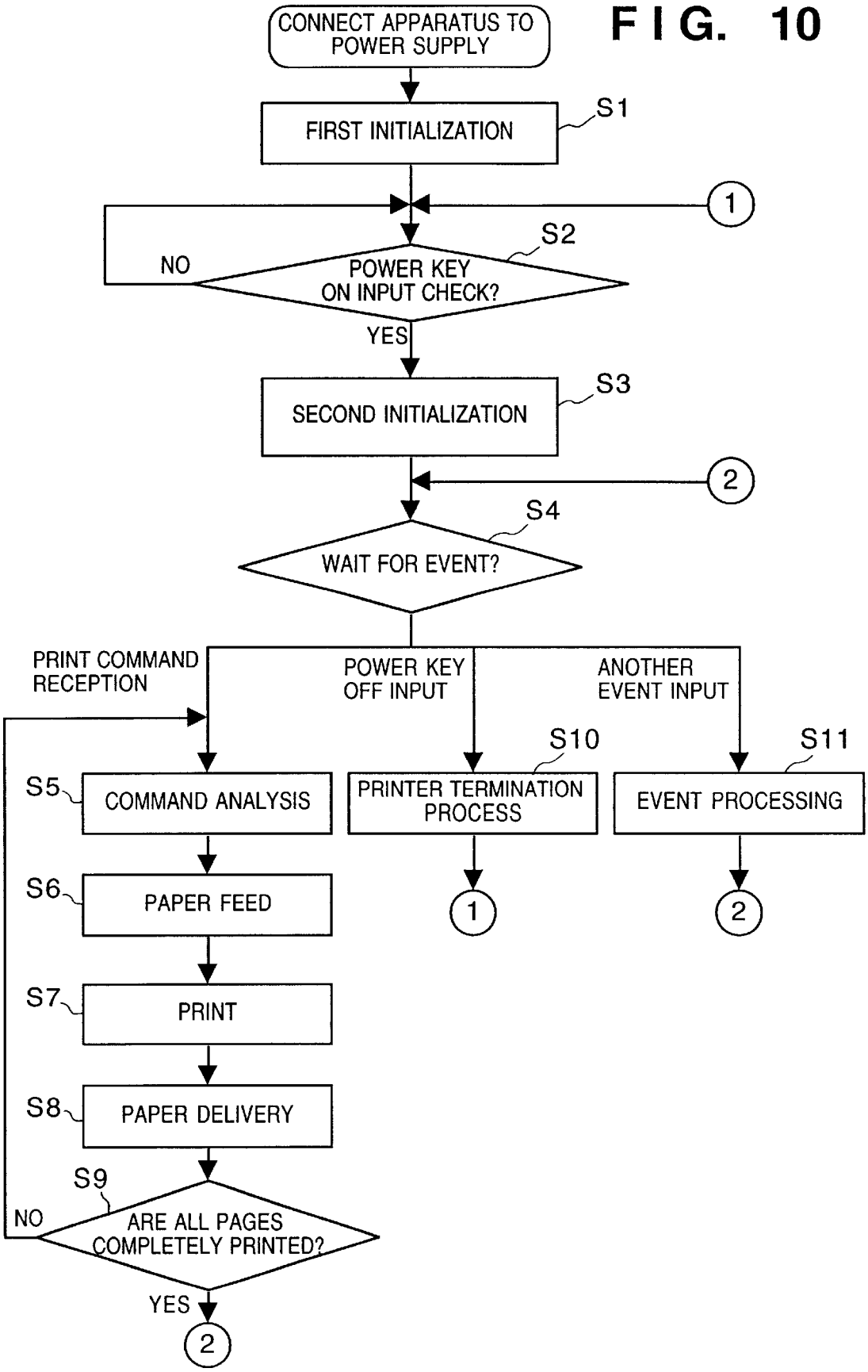
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step S1 first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

This embodiment will exemplify processing when the head unit mounting the printhead H1001 informs the main unit having the main PCB (E0014) for controlling printing of the printhead temperature. Informing operation for temperature information of the printhead H1001 will be described with reference to FIG. 7.

Temperature information of an analog signal of the printhead H1001 detected by the head unit is A/D-converted in the head to determine digital temperature information as temperature information of a digital signal.

The contact FPC (E0011) in contact with the head unit informs the main unit having the main PCB (E0014) via the CRFFC (E0012) of the digital temperature information. The main unit need not execute A/D conversion processing for temperature information of an analog signal of the printhead H1001, and need not execute exclusive control with respect to another A/D conversion processing. Since temperature information transferred from the head unit to the main unit is a digital signal, the influence of noise during data transfer is reduced. Moreover, a digital signal obtained by simply A/D-converting temperature information of an analog signal of the printhead H1001 detected on the head unit side is not informed to the main unit. Instead of this, temperature information of a detected analog signal is converted into a digital signal at an interval of about 5° C. in a temperature range where fine discharge control must be done and at an interval of 10 to 20° C. in the remaining temperature range. Then, the obtained digital signal is informed to the main unit. This easily realizes software guard against an illegal temperature.

Temperature acquisition operation of the printhead according to this embodiment will be explained with reference to FIG. 11.

Figure 11:
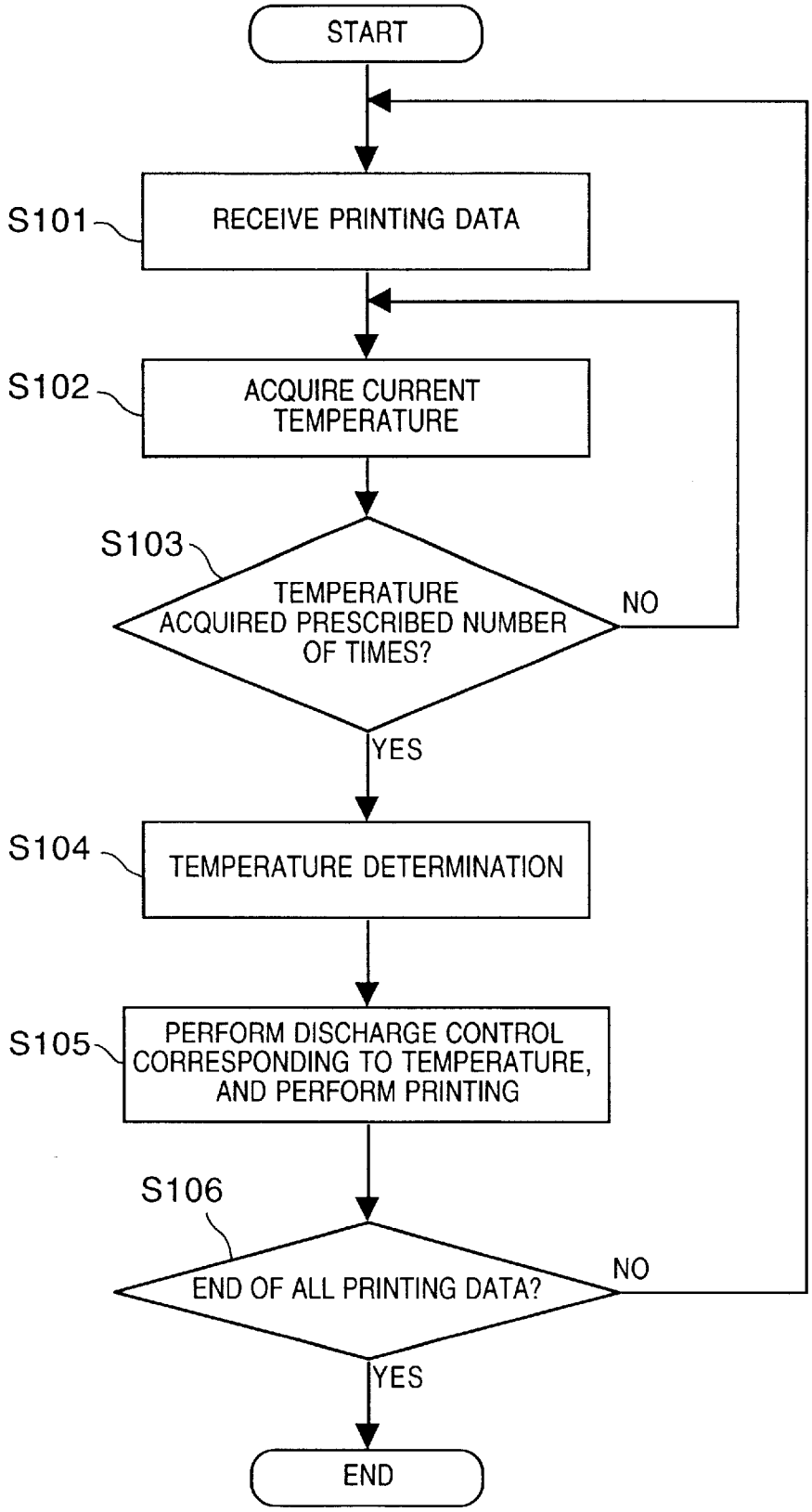
FIG. 11 is a flow chart showing temperature acquisition operation of the printhead in the embodiment.

FIG. 11 is a flow chart showing temperature acquisition operation of the printhead in the embodiment.

In step S101, the printer receives a printing instruction from a host computer connected to the printer, and receives printing data. Upon reception of printing data, the printer acquires digital temperature information of the printhead H1001 in step S102. In step S1003, whether digital temperature information has been acquired a prescribed of number of times is checked. If digital temperature information has not been acquired a prescribed of number of times (NO in step S103), the flow returns to step S102 to acquire head temperature information of the printhead H1001. If digital temperature information has been acquired a prescribed of number of times (YES in step S103), the flow advances to step S104.

In step S104, the temperature of the printhead H1001 is determined by a temperature determination algorithm of averaging the acquired digital temperature information or using a value having the highest frequency. Details of this temperature determination algorithm will be described below. In step S105, various discharge parameters shown in FIG. 12 corresponding to the determined temperature are determined, and set in the ASIC (E1006) to perform printing.

The relationship between the temperature of the printhead H1001, digital temperature information, and discharge parameters will be described with reference to FIG. 12.

FIG. 12 is a table showing the relationship between the printhead temperature, digital temperature information, and discharge parameters in the embodiment.

In this embodiment, temperature information (head temperature) of an analog signal of the printhead H1001 detected on the head unit side is not simply A/D-converted, but is converted into digital temperature information at an interval of about 5° C. in a temperature range where fine discharge control must be done and at an interval of 10 to 20° C. in the remaining temperature range. FIG. 12 shows the relationship between the head temperature and digital temperature information, and the relationship of discharge parameters for each digital temperature information.

In FIG. 12, digital temperature information and discharge parameters correspond to a head temperature of 20° C. to 60° C. at an interval of 5° C. For other temperatures, discharge parameters correspond to them with a larger temperature width. In this manner, fine temperature width control is performed in a range where finer discharge control must be done, and more coarse temperature width control is performed in the remaining range. With this setting, the data amount to be held and the table size can be decreased, and driving control itself based on the temperature can be simplified.

Processing in FIG. 11 will be described again.

In step S106, whether the above processing has been completed for all the received printing data is checked. If the processing has not been completed yet (NO-in step S106), the flow returns to step S101. If the processing has been completed (YES in step S106), it ends.

Details of the operation of the temperature determination algorithm in step S104 of FIG. 11 will be described with reference to FIG. 13.

Figure 13:
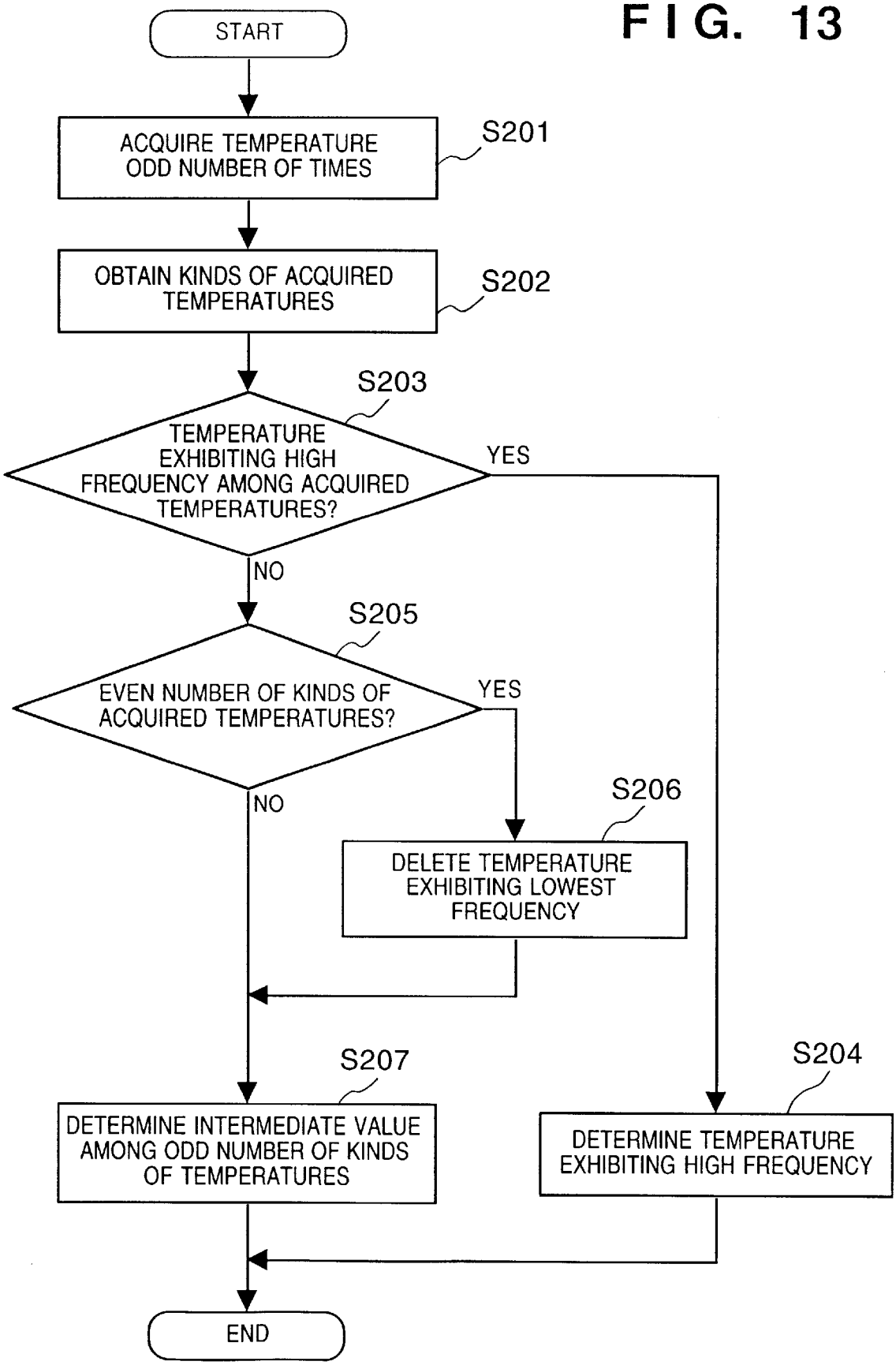
FIG. 13 is a flow chart showing details of the operation of a temperature determination algorithm in step S104 of FIG. 12 in the embodiment.

FIG. 13 is a flow chart showing details of the operation of the temperature determination algorithm in step S104 of FIG. 11 in the embodiment.

In step S201, the number of times of acquiring the temperature of the printhead H1001 is set to an odd number, and the temperatures are acquired. In step S202, the number of kinds of acquired temperatures (digital temperature information in FIG. 12) (the number of different temperature values) is obtained.

In step S203, whether a temperature exhibiting a high acquisition frequency exists in the acquired temperatures is checked. In this step, whether a temperature exhibiting a high acquisition frequency exists is determined based on whether the difference between the numbers of digital temperatures of respective kinds is a predetermined value or more.

If a temperature exhibiting a high acquisition frequency exists (YES in step S203), the temperature is determined as the temperature of the printhead H1001 in step S204. If no temperature exhibiting a high acquisition frequency exists (NO in step S203), whether the number of kinds of acquired temperatures is an even number is checked. If the number of kinds of acquired temperatures is an even number (YES in step S205), the flow advances to step S206, and a temperature exhibiting the lowest acquisition frequency is deleted. Then, the flow shifts to step S207, and a temperature having an intermediate value among the odd number of kinds of temperatures is determined as the temperature of the printhead H1001. If the number of kinds of acquired temperatures is an odd number (NO in step S205), the flow advances to step S207, and a temperature having an intermediate value among the odd number of kinds of temperatures is determined as the temperature of the printhead H1001.

An example of the above-described processing in FIG. 13 will be explained with reference to FIG. 14.

Figure 14:
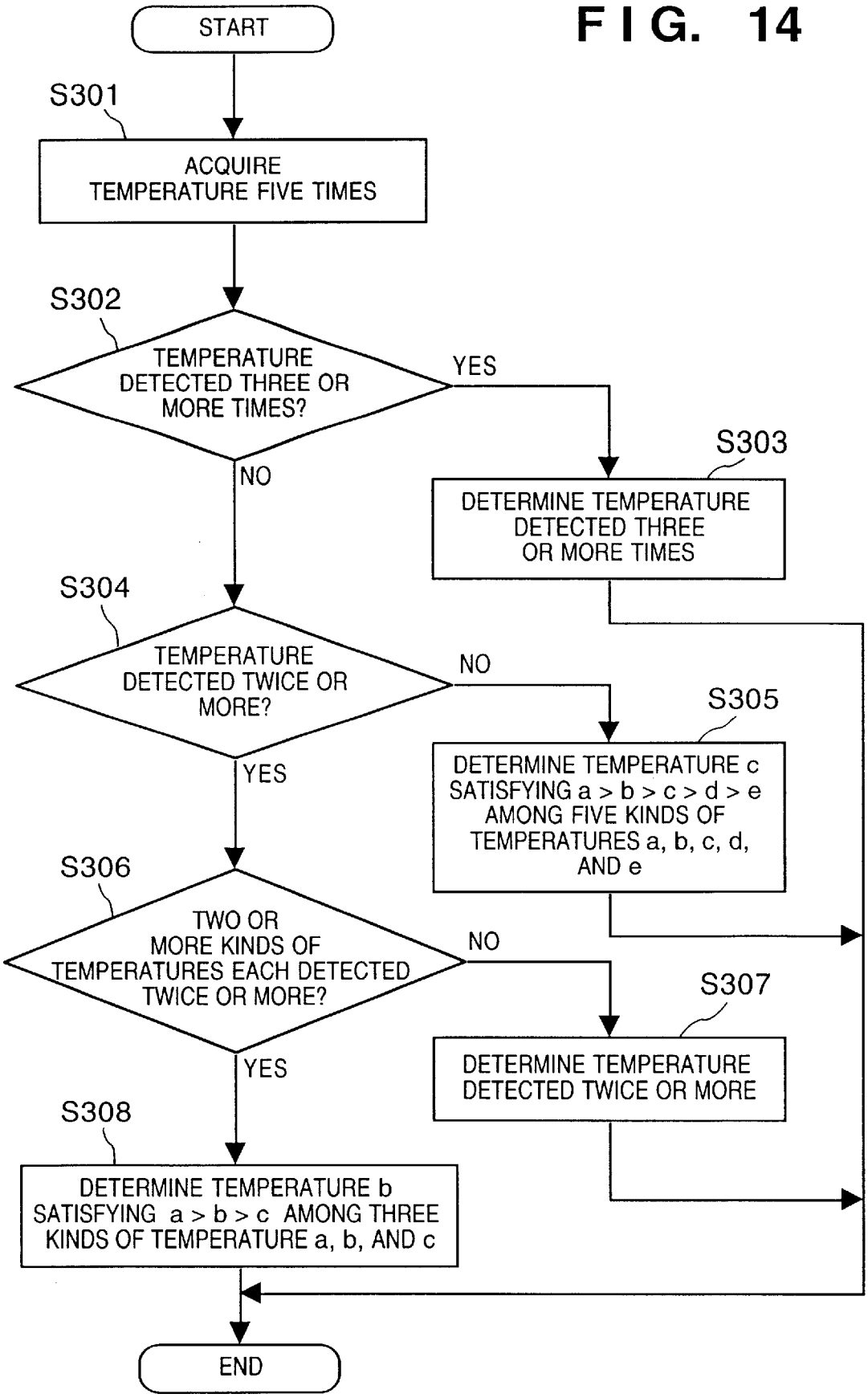
FIG. 14 is a flow chart showing an example of processing in FIG. 13 in the embodiment.

FIG. 14 is a flow chart showing an example of processing in FIG. 13 in the embodiment.

In FIG. 14, the prescribed acquisition number of times of acquiring the temperature of the printhead H1001 is set to five in processing of FIG. 13.

In step S301, the temperature of the printhead H1001 is acquired five times. In step S302, whether a temperature detected three times or more exists in the acquired temperatures is checked. If a temperature detected three times or more exists (YES in step S302), the flow advances to step S303 to determine this temperature as the temperature of the printhead H1001. If a temperature detected three times or more does not exist (NO in step S302), the flow advances to step S304.

In step S304, whether a temperature detected twice or more exists in the acquired temperatures is checked. If a temperature detected twice or more does not exist (NO in step S304), i.e., all the acquired temperatures are different (all the kinds of detected temperatures are different), the flow advances to step S305 to determine, as the temperature of the printhead H1001, temperature c among acquired temperatures a, b, c, d, and e that satisfy $$a>b>c>d>e$$

Processing for detection of the printhead temperature, conversion to a digital value, and determination of the temperature may always be repeated without any instruction from the main unit. In this case, an appropriate digital temperature value can be output immediately when the main unit requires it.

If a temperature detected twice or more exists (YES in step S304), the flow advances to step S306. In step S306, whether two or more kinds of temperatures each detected twice or more exist in the acquired temperatures is checked. If two or more kinds of temperatures do not exist (NO in step S306), the flow advances to step S307 to determine the temperature as the temperature of the printhead H1001. If two or more kinds of temperatures exist (YES in step S306), the flow advances to step S308 to determine, as the temperature of the printhead H1001, temperature b among acquired temperatures a, b, and c that satisfy $$a>b>c$$

Particularly in the above example, optimal temperature data is selected from a plurality of digital temperature data obtained by performing temperature detection a plurality of number of times. Unlike a case wherein the temperature is determined by performing temperature detection only once, a detected temperature can be more appropriately determined even with a detection error such as noise.

When a kind of detected temperature exhibiting a high detection frequency is determined as a head temperature, or an intermediate value among detected temperatures is determined as a head temperature, error values having excessively large or small values due to a detection error can be excluded.

When such a greatly deviated error value does not appear, the average of detected values may be determined as a head temperature.

Instead of selecting any one of detected temperatures, like the above embodiment, an intermediate value may be calculated based on detected temperatures.

(Another Embodiment)

The above embodiment has exemplified the arrangement and method of more accurately detecting the temperature by performing temperature detection a plurality of number of times, and the arrangement and method of, when a plurality of detected temperatures have different temperature values, determining one head temperature from these detected temperatures.

The following embodiment will exemplify an arrangement and method of detecting a more appropriate head temperature by preventing a converted value from changing due to noise or the like when an analog temperature output is converted into a digital value.

Figure 15:
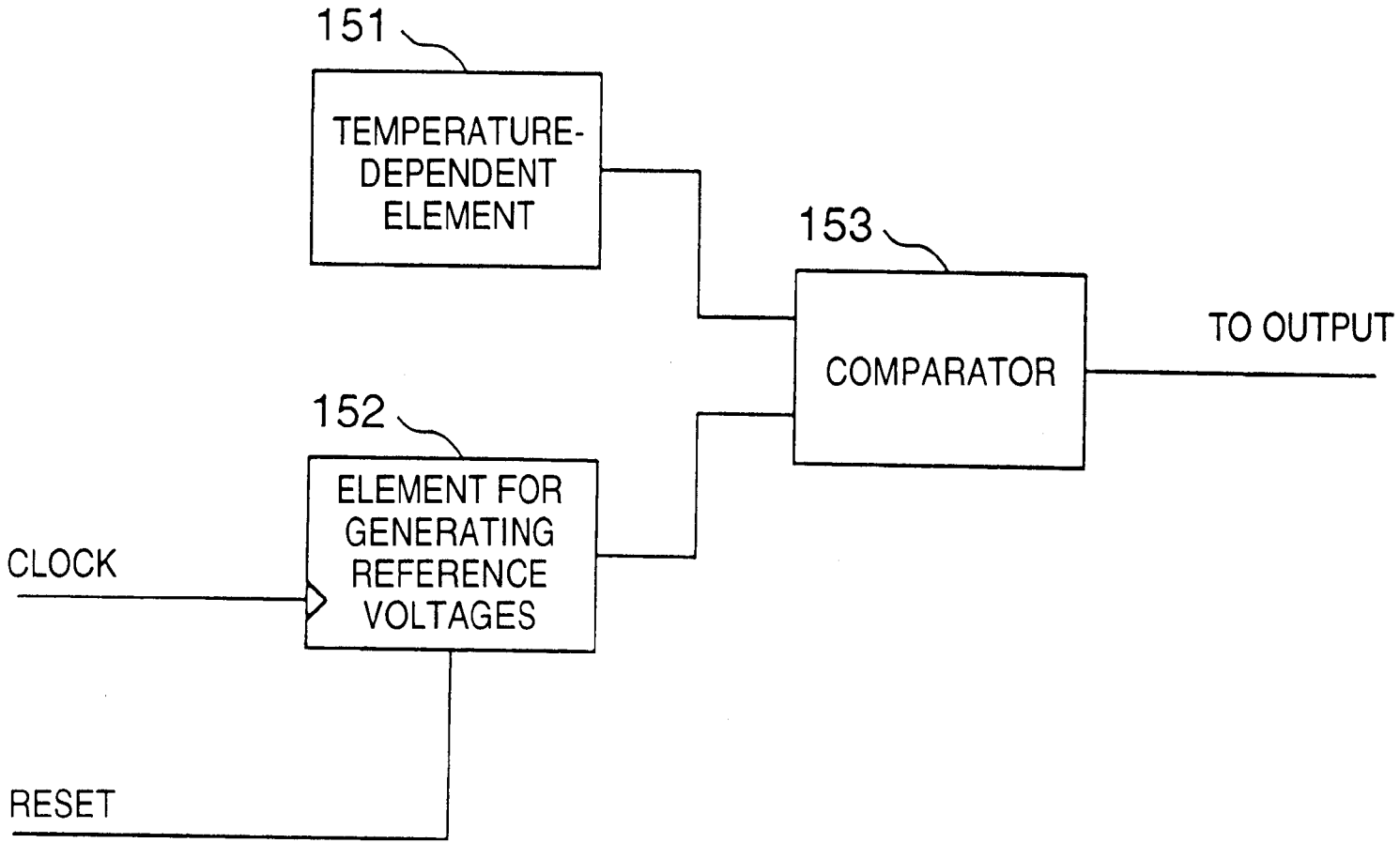
FIG. 15 is a block diagram for explaining an arrangement of converting an analog signal into a digital signal.

An example of outputting the temperature of a head unit as a digital value will be described. A temperature-dependent temperature detection element, and an element 152 for generating a plurality of reference voltages are arranged on a single board on which a heat-generating resistor for discharging ink is also arranged. FIG. 15 shows an example of converting an analog value (voltage value in this case) obtained by a temperature-dependent element 151 into a digital signal.

A comparator 153 sequentially compares a plurality of reference voltages with an output voltage from the temperature detection element 151, and outputs "0" if the output voltage is lower than the reference voltages and "1" if the output voltage is higher.

Figure 16:
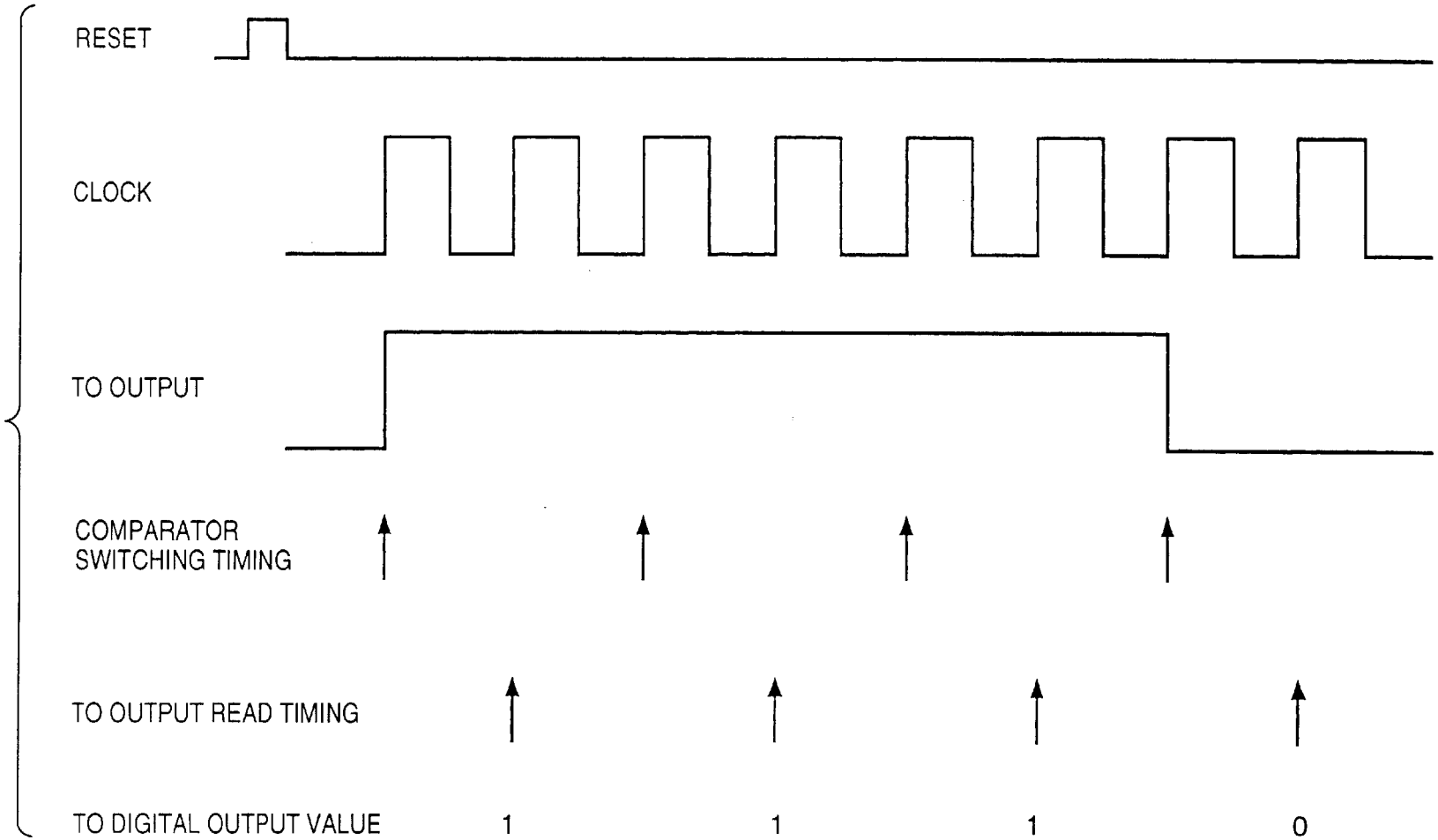
FIG. 16 is a timing chart for explaining the timing of a digital output.
Figure 17:
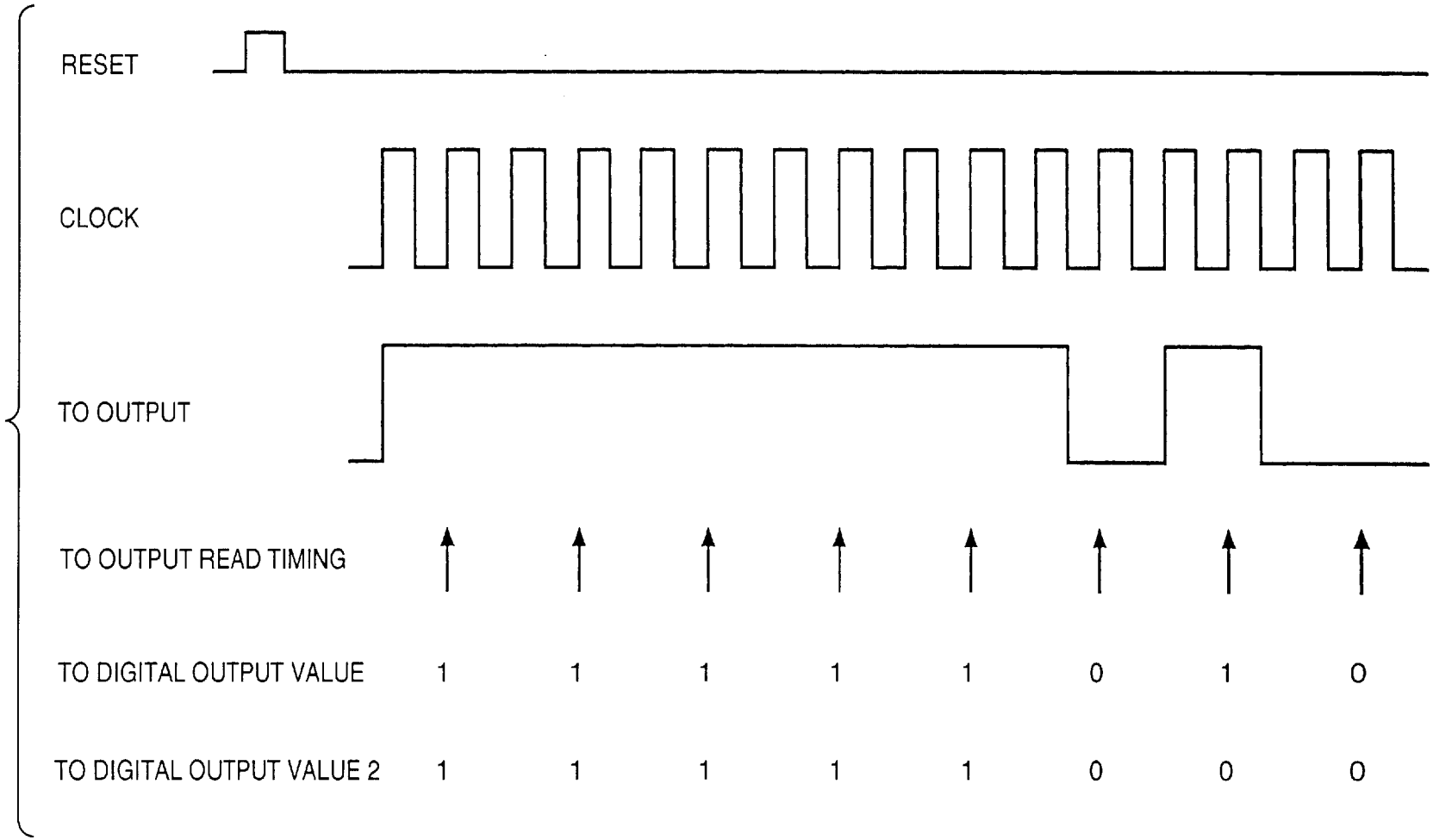
FIG. 17 is a timing chart for explaining the timing of a digital output.

This detection timing is shown in FIGS. 16 and 17.

Reference voltages are reset by a reset signal. The reference voltages are sequentially switched in accordance with clock signals, and comparison values between the reference voltage values and the output voltage are output from the comparator. FIG. 16 shows a state in which bits up to the fourth bit are output. In this embodiment, one temperature is represented by 8 bits, as shown in FIG. 17.

To ensure a time for output from the comparator 153, the reference voltages are switched every time two clock signals are input.

When the output voltage is compared while the reference voltages are switched, an output does not stabilize around the temperature switching point, and the output value of a digital signal does not stabilize and may vary.

This state is shown in FIG. 17.

In some case, a given analog value which should be converted into an 8-bit digital value of "11111000" is converted into "11111010" in which the seventh bit "0" is inverted to "1" owing to the above-described reason. In this case, the erroneous digital value may stop various driving processes.

To prevent this, according to the embodiment, a digital value corresponding to each temperature is assigned in order of bits successive from an upper bit, and when the code changes for the first time upon reset in conversion into a digital value, subsequent signals are ignored.

This processing allows converting an analog value into an appropriate digital value to output the digital value even if an error occurs.

In the above arrangement, the analog value of a detected temperature is converted into a digital value on the board on which the heat-generating resistor of the printhead is arranged. With the use of a plurality of boards, these boards can output pieces of temperature information as digital values. Thus, an output signal line common to the boards can be used, which can greatly reduce the number of wiring lines, compared to a case wherein an analog value is output outside the board.

As described above, according to this embodiment, temperature information of an analog signal of a printhead H1001 detected on the head unit side having the printhead H1001 is converted into a digital signal, and then the temperature information is informed from the head unit to the main unit. This temperature information is informed as temperature information having a certain temperature range to the main unit. The influence of external noise or the like can be suppressed between cables connected between the units. Proper discharge control (heater heating time, and recovery processing such as draining predischarge and cleaning) can be executed.

The above embodiments have been explained by assuming that a droplet discharged from a printhead is ink and that a liquid contained in an ink tank is ink. However, the content of the ink tank is not limited to ink. For example, the ink tank can also contain a processing solution to be discharged onto a printing medium to increase the fixing properties, water resistance, or quality of a printed image.

The above embodiments can increase the density and resolution of printing by using a system which includes a means (e.g., an electrothermal transducer or a laser beam) for generating thermal energy as energy used to discharge ink and causes a state change of the ink by this thermal energy, among other inkjet printing systems.

As a representative arrangement or principle, it is preferable to use the basic principle disclosed in, e.g., U.S. Pat. Nos. 4,723,129 or 4,740,796. This system is applicable to both a so-called on-demand apparatus and continuous apparatus. The system is particularly effective in an on-demand apparatus because at least one driving signal which corresponds to printing information and which gives a rapid temperature rise exceeding nuclear boiling is applied to an electrothermal transducer which corresponds to a sheet or channel holding a liquid (ink), thereby causing this electrothermal transducer to generate thermal energy and cause film boiling on the thermal action surface of a printhead, and consequently a bubble can be formed in the liquid (ink) in one-to-one correspondence with the driving signal. By growth and shrinkage of this bubble, the liquid (ink) is discharged from a discharge orifice to form at least one droplet. This driving signal is more preferably a pulse signal because growth and shrinkage of a bubble are instantaneously appropriately performed, so discharge of the liquid (ink) having high response is achieved.

This pulse driving signal is preferably a signal described in U.S. Pat. Nos. 4,463,359 or 4,345,262. Note that superior printing can be performed by the use of conditions described in U.S. Pat. No. 4,313,124 which is the invention concerning the rate of temperature rise on the thermal action surface.

The arrangement of a printhead can be the combination (a linear liquid channel or a right-angle liquid channel) of the discharge orifices, liquid channels, and electrothermal transducers disclosed in the specifications described above. The present invention also includes arrangements using U.S. Pat. Nos. 4,558,333 and 4,459,600 in each of which the thermal action surface is placed in a bent region. Additionally, it is possible to use an arrangement based on Japanese Patent Laid-Open No. 59-123670 in which a common slot is used as a discharge portion of a plurality of electrothermal transducers or Japanese Patent Laid-Open No. 59-138461 in which an opening for absorbing the pressure wave of thermal energy is opposed to a discharge portion.

Furthermore, a full line type printhead having a length corresponding to the width of the largest printing medium printable by a printing apparatus can have a structure which meets this length by combining a plurality of printheads as disclosed in the aforementioned specifications or can be a single integrated printhead.

In addition, it is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or a preliminary means for a printhead to the printing apparatus described above is preferable because printing can further stabilize. Practical examples of the additional means for a printhead are a capping means, a cleaning means, a pressurizing or drawing means, and an electrothermal transducer or another heating element or a preliminary heating means combining them. A predischarge mode for performing discharge different from printing is also effective to perform stable printing.

A recording mode of the printing apparatus is not restricted to a printing mode using only a main color such as black. That is, the apparatus can have at least a composite color mode using different colors and a full color mode using mixed colors, regardless of whether a printhead is an integrated head or the combination of a plurality of heads.

The above embodiments are explained assuming that ink is a liquid. However, it is possible to use ink which solidifies at room temperature or less but softens or liquefies at room temperature. In inkjet systems, the general approach is to perform temperature control such that the viscosity of ink falls within a stable discharge range by adjusting the temperature of the ink itself within the range of 30° C. to 70° C. Hence, ink need only be a liquid when a printing signal used is applied to it.

Additionally, to positively prevent a temperature rise by thermal energy by positively using this temperature rise as energy of the state change from the solid state to the liquid state of ink, or to prevent evaporation of ink, ink which solidifies when left to stand and liquefies when heated can be used. That is, the present invention is applicable to any ink which liquefies only when thermal energy is applied, such as ink which liquefies when applied with thermal energy corresponding to a printing signal and is discharged as liquid ink, or ink which already starts to solidify when arriving at a printing medium. In the present invention, executing the aforementioned film boiling scheme is most effective for each ink described above.

Furthermore, the printing apparatus according to the present invention can take the form of any of an integrated or separate image output terminal of an information processing apparatus such as a computer, a copying apparatus combined with a reader or the like, and a facsimile apparatus having a transmission/reception function.

The present invention can be applied to a system constituted by a plurality of devices (e.g., a host computer, interface, reader, and printer) or to an apparatus (e.g., a copying machine or facsimile apparatus) comprising a single device.

Further, the object of the present invention can also be achieved by providing a storage medium storing program codes of software for performing the aforesaid functions according to the embodiments to a system or an apparatus, reading the program codes with a computer (or a CPU or MPU) of the system or apparatus from the storage medium, and then executing the program codes.

In this case, the program codes read out from the storage medium realize the functions according to the embodiments, and the storage medium storing the program codes constitutes the invention.

Further, as the storage medium for providing the program codes, it is possible to use, e.g., a floppy disk, hard disk, optical disk, magnetooptical disk, CD-ROM, CD-R, magnetic tape, nonvolatile memory card, and ROM.

Furthermore, besides aforesaid functions according to the above embodiments are realized by executing the program codes which are read out by a computer, the present invention includes a case wherein an OS (Operating System) or the like running on the computer performs a part or the whole of actual processing in accordance with designations by the program codes and realizes functions according to the above embodiments.

Furthermore, the present invention also includes a case where, after the program codes read out from the storage medium are written in a memory of a function extension board inserted into a computer or of a function extension unit connected to a computer, a CPU or the like of the function extension board or function extension unit performs a part or the whole of actual processing in accordance with designations by the program codes and realizes functions of the above embodiments.

When the present invention is applied to the above storage medium, this storage medium stores program codes corresponding to the flow charts shown in FIGS. 11, 13, and 14 explained earlier.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for executing printing control of a printhead on the basis of a temperature of the printhead, comprising:

generation means for detecting a temperature of the printhead a plural number of times and generating a plurality of digital values corresponding to respective temperatures;

determination means for determining a digital value representing the temperature of the printhead on the basis of the plurality of digital values generated by said generation means; and execution means for executing printing control of the printhead on the basis of the digital value determined by said determination means, wherein said generation means is provided in a head unit that includes the printhead.

2. The apparatus according to claim 1, wherein said generation means includes:

detection means for detecting the temperature of the printhead; and conversion means for converting an analog signal representing the temperature detected by said detection means into a digital signal.

3. The apparatus according to claim 1, wherein said determination means determines a digital value serving as an average of the plurality of digital values generated by said generation means as the digital value representing the temperature of the printhead.

4. The apparatus according to claim 1, wherein said determination means determines a digital value based on a value detected the greatest number of times among the plurality of digital values generated by said generation means as the digital value representing the temperature of the printhead.

5. The apparatus according to claim 1, wherein said determination means has discrimination means for, when said generation means detects the temperature of the printhead an odd number of times and generates an odd number of digital values corresponding to respective temperatures, discriminating kinds of digital values constituting the odd number of digital values, and said determination means determines the digital value representing the temperature of the printhead from the odd number of digital values on the basis of a discrimination result of said discrimination means.

6. The apparatus according to claim 5, wherein, when a digital value based on a value detected the greatest number of times does not exist among the odd number of digital values, and the number of kinds of digital values is an even number, a value detected the least number of times is deleted, and said determination means determines a digital value belonging to an intermediate kind among the odd number of kinds of digital values as the digital value representing the temperature of the printhead.

7. The apparatus according to claim 5, wherein when a digital value based on a value detected the greatest number of times does not exist among the odd number of digital values, and the number of kinds of digital values is an odd number, said determination means determines a digital value belonging to an intermediate kind among the odd number of kinds of digital values as the digital value representing the temperature of the printhead.

8. The apparatus according to claim 1, wherein the printhead comprises an inkjet printhead for performing printing by discharging ink.

9. The apparatus according to claim 8, wherein the printhead discharges ink using thermal energy, and comprises a thermal energy converter for generating thermal energy to be applied to the ink.

10. The apparatus according to claim 1, wherein when a detected analog signal is to be converted into a digital signal represented by a plurality of bits, data after a bit at which a bit value changes is ignored, and the analog signal is converted into a digital signal.

11. The apparatus according to claim 1, wherein each of the plurality of digital values represents a temperature range with a predetermined width.

12. The apparatus according to claim 11, wherein the predetermined width of the temperature range is dependent on the temperature of the printhead.

13. The apparatus according to claim 1, wherein said generation means is incorporated in the printhead and said determination means and said execution means are incorporated in a main unit.

14. The apparatus according to claim 13, wherein detection processing of the temperature and determination processing of the digital value are performed without any request from said main unit.

15. The apparatus according to claim 13, further comprising transmission means for transmitting the plurality of digital values generated by said generation means from the printhead to the main unit.

16. A control method of a printing apparatus having a head unit with a printhead and a main unit with a control circuit for executing printing control of the printhead, comprising:

a generation step of detecting a temperature of the printhead a plural number of times and generating a plurality of digital values corresponding to respective temperatures;

a determination step of determining a digital value representing the temperature of the printhead on the basis of the plurality of digital values generated in the generation step; and an execution step of executing printing control of the printhead on the basis of the digital value determined in the determination step, wherein the generation step is performed in the head unit.

17. The method according to claim 16, wherein the generation step includes:

a detection step of detecting the temperature of the printhead; and a conversion step of converting an analog signal representing the temperature detected in the detection step into a digital value.

18. The method according to claim 16, wherein the determination step comprises determining a digital value serving as an average of the plurality of digital values generated in the generation step as the digital value representing the temperature of the printhead.

19. The method according to claim 16, wherein the determination step comprises determining a digital value based on a value detected the greatest number of times among the plurality of digital values generated in the generation step as the digital value representing the temperature of the printhead.

20. The method according to claim 16, wherein the determination step has a discrimination step of, when the temperature of the printhead is detected an odd number of times and an odd number of digital values corresponding to respective temperatures are generated in the generation step, discriminating kinds of digital values constituting the odd number of digital values, and the determination step comprises determining the digital value representing the temperature of the printhead from the odd number of digital values on the basis of a discrimination result in the discrimination step.

21. The method according to claim 20, wherein the method further comprises the step of, when a digital value based on a value detected the greatest number of times does not exist among the digital values constituting the odd number of digital values, and the number of kinds of digital values is an even number, deleting a value detected the least number of times, and the determination step comprises determining a digital value belonging to an intermediate kind among the odd number of kinds of digital values as the digital value representing the temperature of the printhead.

22. The method according to claim 20, wherein the determination step comprises, when a digital value based on a value detected the greatest number of times does not exist among the odd number of digital values, and the number of kinds of digital values is an odd number, determining a digital value belonging to an intermediate kind among the odd number of kinds of digital values as the digital value representing the temperature of the printhead.

23. The method according to claim 16, wherein the printhead comprises an inkjet printhead for performing printing by discharging ink.

24. The method according to claim 23, wherein the printhead discharges ink using thermal energy, and comprises a thermal energy converter for generating thermal energy to be applied to the ink.

25. The method according to claim 16, wherein each of the plurality of digital values represents a temperature range with a predetermined width.

26. The method according to claim 25, wherein the predetermined width of the temperature range is dependent on the temperature of the printhead.

27. The method according to claim 16, further comprising a transmission step for transmitting the plurality of digital values generated in said generation step from the printhead to the main unit.

28. The method according to claim 27, wherein detection processing of the temperature and the determination step of the digital value are performed without any request from the main unit.

29. The method according to claim 16, wherein said generation step generates a digital value as a unit in a predetermined temperature range.

30. A computer-readable memory storing program codes of control of a printing apparatus having a head unit with a printhead and a main unit with a control circuit for executing printing control of the printhead, comprising:

a program code of a generation step of detecting a temperature of the printhead a plural number of times and generating a plurality of digital values corresponding to respective temperatures;

a program code of a determination step of determining a digital value representing the temperature of the printhead on the basis of the plurality of digital values generated in the generation step; and a program code of an execution step of executing printing control of the printhead on the basis of the digital value determined in the determination step, wherein the generation step is performed in the head unit.

31. A printing apparatus for receiving temperature information output as a digital value from a printhead, changing a driving condition of the printhead in accordance with the temperature information, and performing printing, wherein, depending on a temperature range, a temperature width for switching the driving condition of the printhead is changed in accordance with the output temperature information.

32. A printing apparatus for executing printing control of a printhead on the basis of a temperature of the printhead, comprising:

generation means for detecting a temperature of the printhead a plurality of number of times and generating a plurality of digital values corresponding to respective temperatures;

determination means for determining a digital value representing the temperature of the printhead on the basis of the plurality of digital values generated by said generation means; and execution means for executing printing control of the printhead on the basis of the digital value determined by said determination means, wherein said determination means has discrimination means for, when said generation means detects the temperature of the printhead an odd number of times and generates an odd number of digital values corresponding to respective temperatures, discriminating kinds of digital values constituting the odd number of digital values, and said determination means determines a digital value representing the temperature of the printhead from the odd number of digital values on the basis of a discrimination result of said discrimination means.

33. The apparatus according to claim 32, wherein, when a digital value based on a value detected the greatest number of times does not exist among the odd number of digital values, and the number of kinds of digital values is an even number, a value detected the least number of times is deleted, and said determination means determines a digital value belonging to an intermediate kind among the odd number of kinds of digital values as the digital value representing the temperature of the printhead.

34. The apparatus according to claim 32, wherein when a digital value based on a value detected the greatest number of times does not exist among the odd number of digital values, and the number of kinds of digital values is an odd number, said determination means determines a digital value belonging to an intermediate kind among the odd number of kinds of digital values as the digital value representing the temperature of the printhead.

* * * * *